United States Patent [19]

Hall

[11] 4,063,494

[45] Dec. 20, 1977

[54] APPARATUS FOR MAKING FILTER RODS FOR CIGARETTES

[75] Inventor: Floyd Vanmeda Hall, Durham, N.C.

[73] Assignee: Liggett Group Inc., Durham, N.C.

[21] Appl. No.: 769,968

[22] Filed: Feb. 18, 1977

[51] Int. Cl.[2] ..... A24C 5/50

[52] U.S. Cl. ..... 93/77 FT; 83/329

[58] Field of Search ..... 93/77 FT, 1 C; 131/63, 131/65, 118, 264, 265, 266; 83/329, 330, 926 C, 913

[56] References Cited

U.S. PATENT DOCUMENTS

| | | | |
|---|---|---|---|
| 1,242,478 | 10/1917 | Rosewarne | 83/329 X |
| 3,357,321 | 12/1967 | Hall | 93/1 C |
| 3,464,421 | 9/1969 | Pinkham et al. | 93/1 C X |

FOREIGN PATENT DOCUMENTS

| | | | |
|---|---|---|---|
| 253,666 | 4/1967 | Austria | 83/329 |

*Primary Examiner*—James F. Coan

*Attorney, Agent, or Firm*—J. Bowen Ross, Jr.; Michael L. Hendershot

[57] ABSTRACT

The apparatus employs two cutting discs which are spaced apart from each other laterally to sever plugs of different lengths from a travelling rod of filter material. The plugs alternate in size, for example, between 24 millimeters and 14 millimeters and are subsequently spaced apart so as to receive charcoal or other particulate filter material in the intermediate spaces. The resulting filter has the charcoal chamber closer to the tobacco end of the cigarette than to the exposed end of the cigarette. The cutting discs are mounted on a drum which rotates in synchronism with a recessed ledger through which the respective cutting discs pass to sever the travelling rod of filter material.

17 Claims, 10 Drawing Figures

10
11
12
13
14
15
16
17
18
19
20
21
22
23
24
25
26
27
28
29
30
31
33
34
35
36
37
38
40
41
42
43
44
9°
6°
F

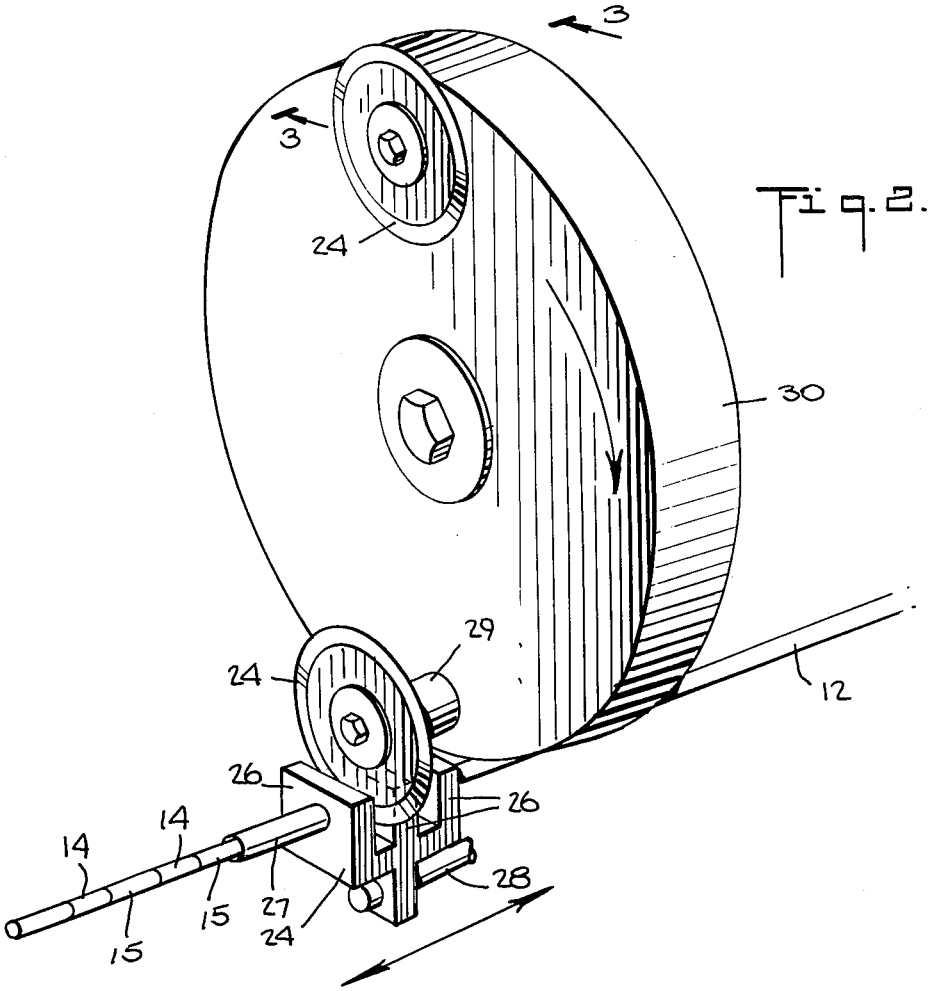
Fig. 2.
Fig. 5.
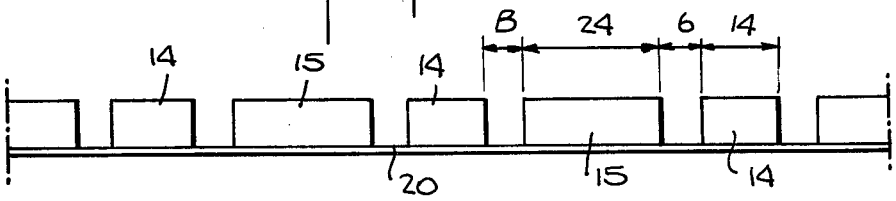
Fig. 6.
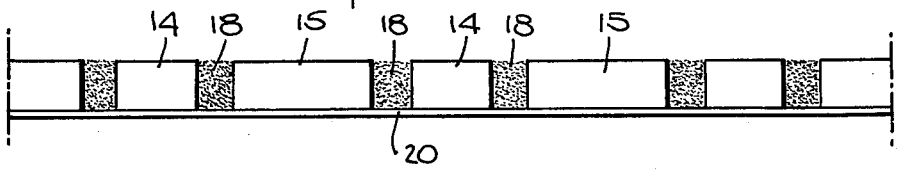

Fig. 4.
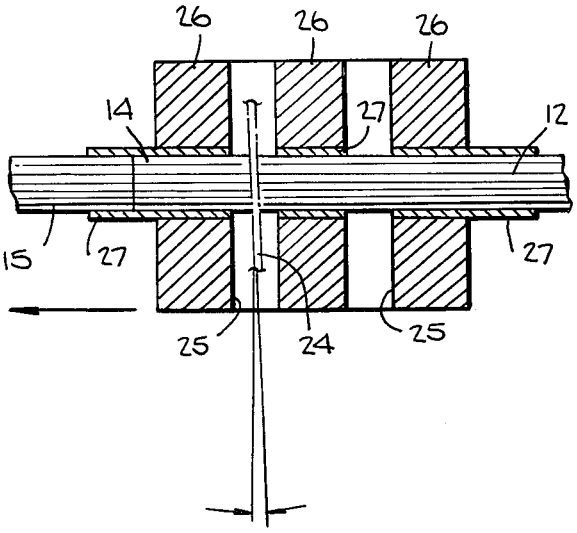
Fig. 7.
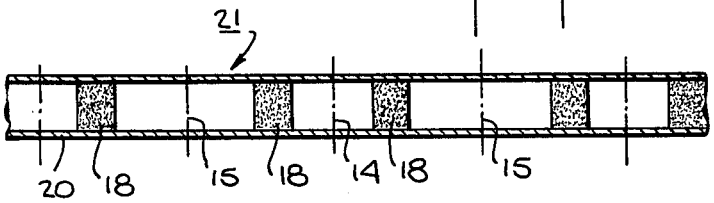
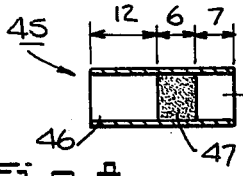
Fig. 8.
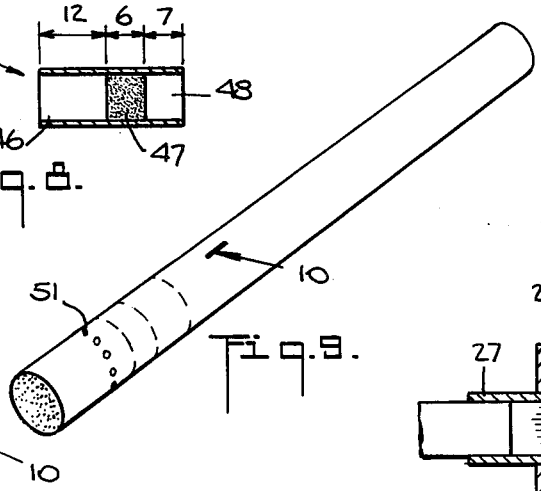
Fig. 9.
Fig. 10.
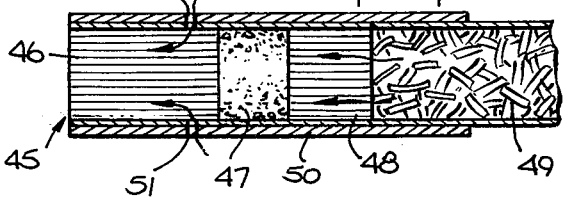
Fig. 3.
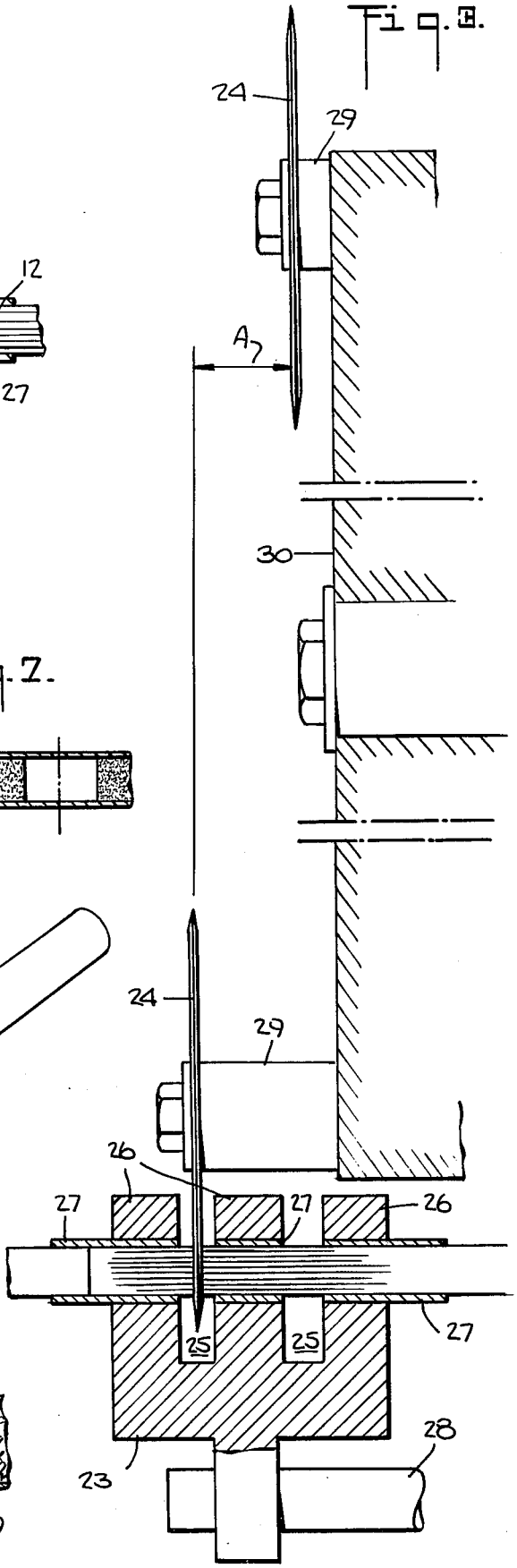

APPARATUS FOR MAKING FILTER RODS FOR CIGARETTES

This invention relates to an apparatus for making filter rods for cigarettes. More particularly, this invention relates to a knife assembly for severing a moving rod of filter material into individual plugs for incorporation into a filter rod.

Various types of filters have been known for cigaretts. In some cases, filters have been made of a single type of material while, in other cases, filters have been made of different filter materials in multi-sectional type constructions. For example, one known multi-sectional filter has been composed of two sections of cellulose acetate material separated by a chamber containing charcoal or other particulate type filter material with the sections of cellulose acetate material symmetrically disposed about the chamber of charcoal material. In some cases, these filters have been provided with circumferential perforations to permit air to be drawn into and through the acetate sections during smoking for various purposes. However, in some instances, particularly in the case of multi-sectional component cigarettes, the perforations have been placed too close to the end of the cigarette such that, during smoking, the smoker inadvertantly covers over the perforations. As a result, no air or an insufficient amount of air is drawn into the filter during smoking to accomplish the purposes desired. In other instances, the charcoal has been positioned too far from the tobacco to be completely effective against the hot gases passing from the tobacco.

Accordingly, it is an object of the invention to provide a filter of multi-component construction with perforations which cannot be inadvertantly covered over during smoking.

It is another object of the invention to provide a simple apparatus for making multi-component filters with components of different lenghts.

It is another object of the invention to position the charcoal chamber of a multi-component filter closer to one end of the filter than the other end.

It is another object of the invention to provide a simple apparatus for producing filter plugs of different alternating lengths.

Briefly, the invention provides an apparatus for making filter rods for cigarettes which employs a knife assembly for severing a moving rod into successive plugs of different lengths. The apparatus also includes a means for delivering a continuous rod of entrainment type filter material in a predetermined path to the knife assembly as well as a means for spacing the severed plugs at equal spacings from each other downstream of the knife assembly. In addition, the apparatus includes means for sequentially deposited adsorptive material between the spaced plugs, a means for wrapping a strip of paper around the plugs and adsorptive filter material to form a continuous filter rod and a knife for severing the continuous filter rod into predetermined lengths.

The knife assembly includes a ledger having a pair of recesses and pair of cutting discs each of which is positioned to pass through a respective one of the recesses of the ledger. The ledger has guide tubes which extend across the recesses in coaxial alignment in order to guide the moving rod through the ledger. These guide tubes are spaced apart within each recess to expose the rod for severing by the cutting discs. The discs, in turn, are mounted in projecting manner from a side of a rotatable drum with each disc projecting from the drum a different amount from the other. For example, the discs are laterally spaced relative to the drum a distance of 5 millimeters.

During use, the rod of filter material is passed into the first guide tube of the ledger and passes through the first recess into the second guide tube. The first cutting disc then severs the rod to produce a first plug, for example, of a length of 24 millimeters. Continued delivery of the rod pushes this plug forwardly into the third guide tube while the rod itself continues into the third guide tube. At this time, the second cutting disc passes into the second recess of the ledger and severs the rod to produce a second plug, for example of a length of 14 millimeters. Next, the first cutting disc again passes into a first recess to sever a plug, for example of 24 millimeters. This operation continues in this manner to cut alternating plugs of different lengths. These plugs are then carried from the exit end of the ledger to receive the adsorptive filter material in the spaces therebetween.

The speed cf the rod through the ledger and the speed of the drum on which the cutting discs are mounted as well as the position of the cutting discs on the drum are such as to effect the severing of the rod to produce plugs of determined lengths. Should a need arise to change these plug lengths, the speed of the delivered rod can be varied or the speed of the drum can be varied.

In order to permit the cutting discs to form an even cut without bunching of the rod behind the discs, the discs are disposed at a slight angle and the ledger is moved forwardly during a severing operation. After severing is complete, the ledger can move rearwardly so as to move into proper position for the next cut.

The means for sequentially depositing the adsorptivetype filter material can be of generally known construction. For example, this means may include a rotatable wheel having a plurality of peripherally spaced chambers to receive and discharge the filter material between the filter plugs. These chambers are spaced about the wheel in alternately spaced fashion so as to align the recesses with the spaces between the filter plugs passing thereunder. In such a case, the filter containing chambers of the wheel may be emptied individually or in pairs as the stream of spaced apart plugs passes under the wheel.

These and other objects and advantages of the invention will become more apparent from the following detailed description and appended claims taken in conjunction with the accompanying drawings in which:

FIG. 2 illustrates a knife assembly in accordance with the invention;

FIG. 3 illustrates a view taken on line 3—3 of FIG. 2;

FIG. 4 illustrates a schematic plan view of a ledger in accordance with the invention;

FIG. 5 illustrates a view of a stream of plugs severed in accordance with the invention;

FIG. 6 illustrates a stream of plugs with particulate adsorptive material deposited in the spaces between the filter plugs in accordance with the invention;

FIG. 7 illustrates a portion of a filter rod produced in accordance with the invention;

FIG. 8 illustrates a cross-sectional view of a filter produced in accordance with the invention;

FIG. 9 illustrates a cigarette employing a filter made in accordance with the invention; and FIg. 10 illustrates a view taken on line 10—10 of FIG. 9.

Figure 1:
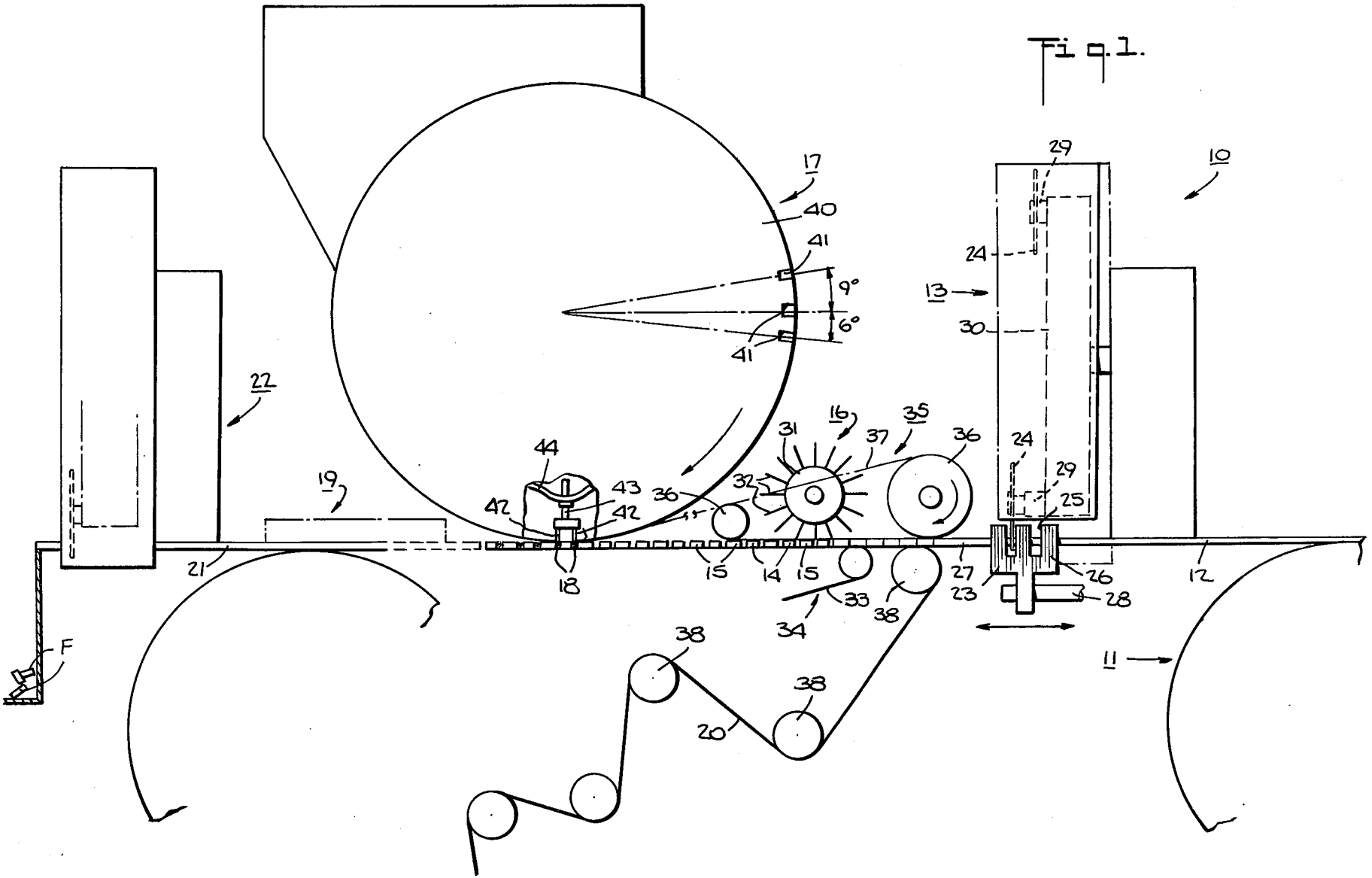
FIG. 1 illustrates a schematic view of an apparatus in accordance with the invention.

Referring to FIG. 1, the apparatus 10 includes a means 11 for delivering a continuous rod 12 of entrainment type filter material, such as cellulose acetate in a predetermined path. In addition, the apparatus 10 includes a knife assembly 13 in the path of the rod for severing discrete plugs 14, 15 from the rod 12 with alternate plugs being of different length. In addition, the apparatus 10 includes a means 16 for spacing the plugs 14, 15 at equal spacings from each other, a means 17 for sequentially depositing adsorptive-type filter material 18 between the plugs 14, 15, a means 19 for wrapping a strip of paper 20 around the plugs 14, 15 and filter material 18 to form a continous filter rod 21 and a knife 22 for severing the rod 21 into predetermined lengths.

The means 11 for delivering the rod 12 of filter material is of conventional structure and generally employs a conveyor of endless belt type of carry along and deliver the rod 12.

Referring to FIGS. 1, 2 and 3, the knife assembly 13 includes a ledger 23 and a pair of cutting discs 24, blades or the like. The ledger 23 is of generally block shape construction and is formed with two recesses 25 between three walls 26. Each of these walls 26 has a guide tube 27 mounted therein in coaxial alignment with the other tubes 27. The ledger 23 is interposed in the path of the rod 12 to guide the rod 12 through the guide tubes 27 and through the respective recesses 25. In addition, the ledger 23 is fixedly mounted on a shaft 28 of a reciprocating means for reciprocating the ledger 23 within the path of the rod 12.

Referring to FIG. 2, each of the cutting discs 24 is rotatably mounted on a shaft 29 which is driven in an orbital path by a suitable means as is known. For example, the cutting discs shafts 29 are rotatably mounted on a rotatable drum 30 which is driven off the transmission of the apparatus 10 in known fashion. As shown in FIG. 4, each disc 24 is mounted on the shaft 29 at a slight angle for purposes as described below.

Referring to FIG. 2, the cutting discs 24 are positioned to pass through a respective one of the recesses 25 of the ledger 23. To this end, the cutting discs 24 are spaced laterally from each other relative to the drum 30, for example for a distance A from center-to-center of five millimeters. In similar fashion, the recesses 25 of the ledger 23 are spaced apart from center-to-center the same distance.

The reciprocating motion of the ledger 23 and the rotatable motion of the drum 30 are synchronized such that each cutting disc 24 passes through a respective recess 25 as the cutting disc 24 reaches the lowermost position of the drum 30 as illustrated in FIG. 2 and as the ledger 23 moves into a forwardmost position. The ledger 23 moves rearwardly after a cutting disc has passed through the recess 25 of the ledger 23.

Referring to FIG. 3, as the rod 12 passes through the guide tubes 27 of the ledger 23, the cutting discs 24 sequentially pass through the alternate recesses 25. At such times, each cutting disc 24 severs the rod to produce a filter plug 14, 15. However, due to the distance A between the cutting discs 24, the plug cut by the right hand disc 24, as viewed in FIG. 3 effects a longer plug length (15) while the left hand cutting disc severs a shorter plug (14).

Referring to FIG. 1, the means 16 for spacing the plugs 14, 15 is of generally known construction. For example, the spacing means 16 may be constructed as a spoked wheel 31 having a plurality of spokes 32 which project into the path of the plugs 14, 15. Also, the spacing means 16 may be in the form of a rotatable drum having spiral flutes as described in U.S. Pat. No. 3,357,321. As shown, the plugs 14, 15 pass from the last guide tube 27 of the ledger 23 directly onto the paper 20 and a conveyor belt 33 of a conveyor 34 of known construction. In addition, the plugs 14, 15 are held on the conveyor belt 33 by a suitable holddown device 35 composed of a pair of pulley wheels 36 and two endless belts 37. The belts 37 serve to hold the plugs 14, 15 on the conveyor belt 33 while the spoked wheel 31 is placed between the endless belts 37 so as to effect a uniform spacing between the filter plugs 14, 15 on the conveyor belt 33. The speed of the spoked wheel 31 is timed with the speed of the conveyor 33 and the filter rod 12 so as to produce a uniform spacing between the plugs 14, 15.

Alternatively, the means for spacing the plugs 14, 15 at equal spacings may be of other suitable known structure. For example, one pulley wheel 36 of the holddown assembly 35 and one guide roller 38 over which the paper 20 is guided may be positioned at an exit point of the ledger 23 and positively driven to initially grip and move the emerging filter plug from the guide tube 27 at a faster speed than the speed of the rod 12 behind the plug. Thus, as the ledger 23 reciprocates rearwardly and then forwardly, the next filter plug severed from the rod 12 is at a spacing from the previously severed plug.

Referring to FIG. 1, the means 17 for depositing the adsorptive type filter material is of generally known construction, e.g. as described in U.S. Pat. No. 3,259,029. To this end, the means 17 is in the form of a rotatable wheel 40 having a plurality of peripherally spaced chambers 41 which receive and discharge the filter material 18. These chambers 41 are spaced about the wheel in alternately spaced fashion, for example in alternating angular increments of 6° and 9°. Each chamber 41 cooperates with a piston 42 in known fashion and with a plunger 43 which pushes the pistons 42 into the chamber 41 at a discharge station at the lower end of the wheel 40. For this purpose, the plunger 43 is actuated by a cam 44 of known construction.

This means 19 for wrapping the paper 20 about the plugs 14, 15 and filter material 18 is of any suitable known construction, such as the conventional garniture section. Similarly, the knife 22 for severing the filter rod 21 is of conventional structure. Consequently, these structures need not be further described.

Referring to FIG. 5, as the plugs 14, 15 pass out of the knife assembly 13 and are spaced apart on the conveyor 34, each is spaced from the other by an equal distance B of, for example 6 millimeters. As shown in FIG. 6, the adsorptive filter material 18 is deposited into the spaces between the filter plugs 14, 15 in conventional fashion.

Referring to FIG. 7, the resulting filter rod 21 contains repeating sections of the plugs 14, 15 and filter material 18. Generally, the length F (FIG. 1) which are cut from the filter rods 21 are sufficient to provide six filters. In the example given, for alternating plugs of lengths of 14 millimeters and 24 millimeters and a charcoal containing chamber of 6 millimeters in length, the severed filter rod lengths are 150 millimeters. As shown in FIG. 8, the individual filters 45 severed from these rods 21 include a filter plug section 46 of a length of 12 millimeters, a charcoal chamber 47 of 6 millimeters in length and a filter plug section 48 of a length of 7 millimeters. This filter 45 can be secured to a tobacco column 49, for example, by a strip of mouthpiece paper 50. The positioning of the filter 45 on the tobacco column 49 is such that the longer plug 46 is disposed at the free end of each cigarette. In addition, perforations 51 can be formed in the mouthpiece paper 50 as well as in the paper surrounding the filter plug 46. These perforations 51 can be provided in known manner. The position of the perforations 51 relative to the end of the cigarette is such as to permit a smoker's mouth to envelop the end of the cigarette without covering over the perforations 51.

The invention thus provides a knife assembly which can be mounted on known machines in a relatively simple manner. Further, the invention provides an apparatus for making mulit-component filter rods in a simple reliable manner for use in air dilution type filters.

The invention further provides a means for increasing the efficiency of the charcoal within a multi-component filter. To this end, the charcoal is placed away from the smoker and closer to the hot gases emanating from the tobacco column of the cigarette. Also, there is less chance that the charcoal can be exposed at the smoker's end of the cigarette to detract from the aesthetic appearance of the cigarette.

What is claimed is:

1. An apparatus for making filter rods for cigarettes comprising means for delivering a continuous rod of entrainment-type filter material in a predetermined path;

a knife assembly in said path for severing discrete plugs from said rod with alternate plugs being of different length;

means for spacing said plugs at equal spacings from each other;

means for sequentially depositing adsorptive-type filter material between said plugs;

means for wrapping a strip of paper around said plugs and said adsorptive type filter material to form a continuous filter rod; and a knife for severing said continuous filter rod into predetermined lengths.

2. An apparatus as set forth in claim 1 wherein said knife assembly includes a ledger having a pair of recesses therein and guide tubes to guide the continuous rod of filter material through said recesses, and a knife having a rotatable drum transverse to said path and a pair of cutting disks mounted on and projecting from said drum in a direction parallel to said path for passage of a respective cutting disk through a respective recess of said ledger.

3. An apparatus as set forth in claim 1 wherein said knife assembly includes a ledger having a pair of recesses therein and guide tubes to guide the continuous rod of filter material through said recesses, and a pair of cutting disks, each said cutting disk being positioned to pass through a respective one of said recesses of said ledger.

4. An apparatus as set forth in claim 3 wherein said cutting disks are spaced laterally from each other relative to said drum a distance equal to five millimeters.

5. An apparatus as set forth in claim 3 wherein said ledger is reciprocally mounted in said path.

6. An apparatus as set forth in claim 5 wherein said knife assembly includes a rotatable drum having said cutting disks mounted thereon.

7. An apparatus as set forth in claim 1 wherein said means for sequentially depositing adsorptive-type filter material includes a rotatable wheel having a plurality of peripherally spaced chambers to receive and discharge the adsorptive-type filter material, said chambers being spaced about said wheel in alternately spaced fashion.

8. An apparatus as set forth in claim 7 wherein said chambers are spaced apart in alternating increments of 6° and 9° about said wheel.

9. An apparatus as set forth in claim 1 wherein said knife assembly severs the continuous rod into plugs of alternating lengths of 14 millimeters and 24 millimeters.

10. A knife assembly for severing a moving rod of filter material comprising a ledger having a pair of recesses therein and guide tubes in coaxial alignment to guide a moving rod of filter material through said recesses of said ledger to expose the rod in each recess; and a knife having a rotatable drum and a pair of rotatable cutting disks mounted in projecting manner from a side of said drum with said cutting disks projecting from said drum a different amount for passage of a respective cutting disk through a respective recess of said ledger.

11. A knife assembly as set forth in claim 10 which further comprises means for reciprocating said ledger relative to the moving rod of filter material and said drum.

12. A knife assembly as set forth in claim 10 wherein said cutting disks are spaced laterally from each other relative to said drum a distance equal to 5 millimeters.

13. In an apparatus for making filter rods, the combination comprising means for delivering a continuous rod of entrainment-type filter material in a predetermined path; and a knife assembly in said path for severing discrete plugs from said rod with alternate plugs being of different length, said knife assembly including a ledger having a pair of recesses therein and guide tubes to guide the continuous rod of filter material through said recesses, and a pair of cutting disks, each said cutting disk being positioned to pass through a respective one of said recesses of said ledger.

14. A knife assembly for severing a moving rod of filter material comprising a ledger having a pair of laterally spaced recesses therein and spaced guide tubes in coaxial alignment to guide a moving rod of filter material through said recesses of said ledger, and a knife having a pair of cutting disks mounted in laterally spaced manner from each other for sequential passage of a respective cutting disk through a respective recess of said ledger.

15. A knife assembly as set forth in claim 14 wherein said knife further includes a rotatable drum having said disks mounted thereon in diametrically opposite positions.

16. An apparatus for making filter rods for cigarettes comprising means for delivering a continuous rod of entrainment-type filter material in a predetermined path;

a knife assembly in said path for severing discrete plugs from said rod with alternate plugs being of different length;

means for sequentially depositing adsorptive-type filter material between said plugs;

means for wrapping a strip of paper around said plugs and said adsorptive type filter material to form a continuous filter rod; and a knife for severing said continuous filter rod into predetermined lengths.

17. An apparatus as set forth in claim 16 wherein said knife assembly includes a ledger having a pair of laterally spaced recesses therein and spaced guide tubes to guide the continuous rod of filter material through said recesses, and a knife having a pair of cutting disks mounted in laterally spaced manner from each other relative to said path for sequential passage of a respective cutting disk through a respective recess of said ledger.

* * * * *